US005167105A

United States Patent [19]

Isban et al.

[11] Patent Number: 5,167,105

[45] Date of Patent: Dec. 1, 1992

[54] HOLLOW DOOR CONSTRUCTION USING AN IMPROVED VOID FILLER

[75] Inventors: Leonard D. Isban, Plymouth; Michael A. Isban, South Bend, both of Ind.

[73] Assignee: American Containers, Inc., Plymouth, Ind.

[21] Appl. No.: 679,308

[22] Filed: Apr. 2, 1991

[51] Int. Cl.[5] ..... E06B 3/72; E04C 2/24

[52] U.S. Cl. ..... 52/455; 52/809; 52/309.11

[58] Field of Search ..... 52/311, 314, 785, 455–458, 52/806, 808, 807, 809, 309.11

[56] References Cited

U.S. PATENT DOCUMENTS

| | | | |
|---|---|---|---|
| 1,183,842 | 5/1916 | Alling | 52/455 |
| 4,236,365 | 12/1980 | Wheeler | 52/455 |
| 4,583,338 | 4/1986 | Sewell et al. | 52/456 |

*Primary Examiner*—James L. Ridgill, Jr.
*Attorney, Agent, or Firm*—James D. Hall

[57] ABSTRACT

An improved hollow paneled door construction using an improved void filler that is expandable and which has components of a specific thickness except for relieved sections of reduced thickness to overlie the panels between the doorskins.

4 Claims, 3 Drawing Sheets

HOLLOW DOOR CONSTRUCTION USING AN IMPROVED VOID FILLER

FIELD OF THE INVENTION

This invention relates to a hollow door construction and more specifically to the use of an improved void filler and its application to a hollow molded door with panels.

BACKGROUND AND SUMMARY OF THE INVENTION

Intricate molded panel doors with indented decorative patterns have become a popular feature in the building construction industry, particularly in home construction. Such doors are of a hollow molded construction with generally multiple panels. Doors of this nature usually have void filler in the form of blocks or spacers inserted between the inner and outer doorskins. These spacers are strategically placed between the panels and extend from one doorskin to the other. The spacers provide the hollow door with structural support to prevent bowing or oil canning of the door.

Hollow door void fillers have typically been in the form of wood block spacers and other fillers made of corrugated paper material. Such corrugated fillers have also been expandable and of a uniform thickness. The raised panel door construction presented an unusual problem for the corrugated expandable type filler in that the raised molding surrounding the panels on the inside surface of the doorskin make it difficult for the corrugated filler to be laid flat and flush with the door frame due to its uniform thickness. Because of these difficulties, use of expandable void fillers in panel doors became impractical for high volume door production. Also, the prior art void fillers were usually applied by hand, strategically positioned and glued, making this an expensive process.

The void filler of this invention is a cost effective and practical solution to the oil canning problem inherent in a hollow door construction. It provides an important structural support feature strengthening the entire hollow door construction. This void filler also provides the industry with a more efficient filler assembly that can be easily and rapidly applied.

Accordingly, it is an object of this invention to provide for an improved door construction void filler for use inside hollow doors with panels.

It is a further object of this invention to provide an improved door construction void filler which is of sufficient strength and rigidity so as to prevent oil canning of the doorskins.

Other objects of the invention will become apparent upon consideration of the detailed description of the preferred embodiment of the present invention taken with the accompanying drawings.

DESCRIPTION OF THE PREFERRED EMBODIMENT

The preferred embodiment herein described is not intended to be exhaustive or to limit the application to the precise form disclosed. Rather, it is chosen and described to explain the principles of the invention and its application and practical use to enable others skilled in the art to utilize the invention.

Figure 2:
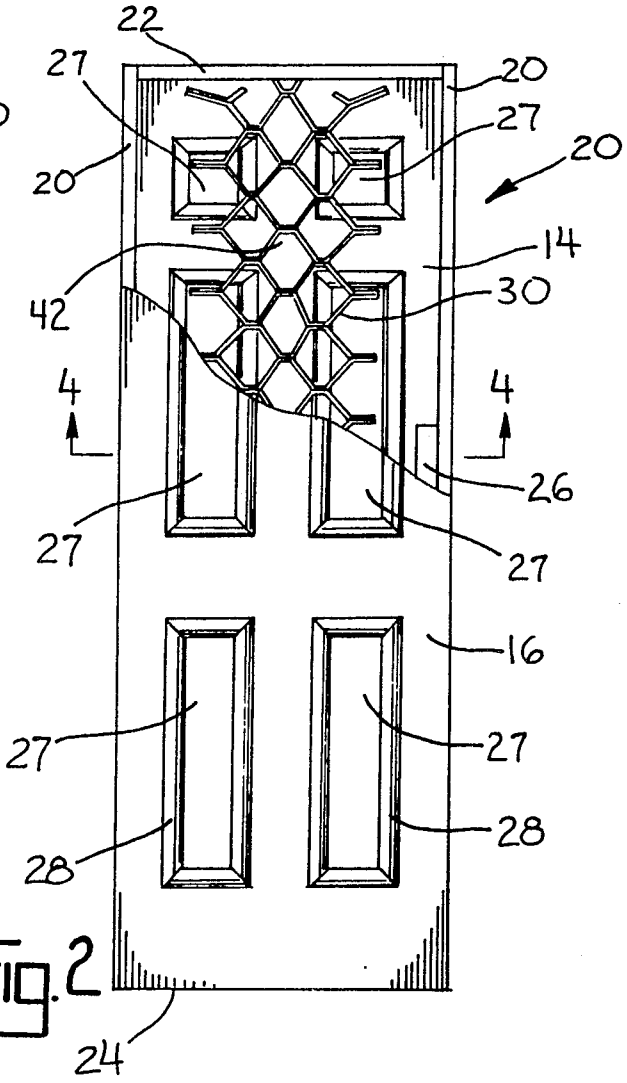
FIG. 2 is a front perspective view of a hollow door partially cut away to show the void filler.
Figure 1:
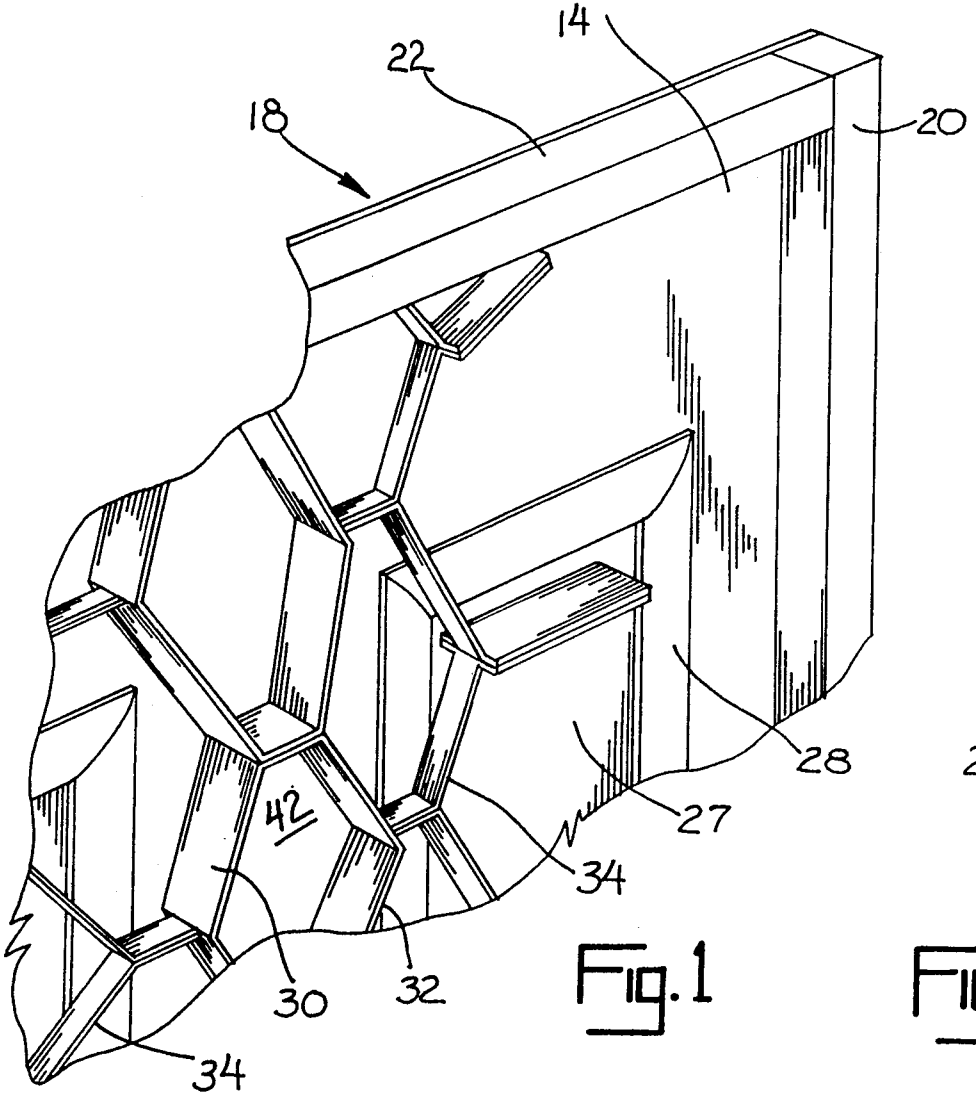
FIG. 1 is an enlarged rear perspective view of a hollow door using the void filler of the invention and with portions of the inner skin removed for illustrative purposes.

The hollow door 12 illustrated in FIGS. 1–2 includes an inner doorskin 14 and on outer doorskin 16. Doorskins 14, 16 are joined by a peripheral frame 18 having two spaced parallel side members 20, an upper frame member 22, and a lower frame member 24. A void filler 30 is placed between the doorskins 14, 16 within peripheral frame 18. Door 12 also includes a lock block 26 placed adjacent to the frame vertical side member 20 and into which the lock set is fitted.

Formed in each doorskin 14, 16 is a series of panels 27 each outlined by a raised molding 28 formed in the interior surface of the doorskin. Door 12 is shown with a series of six panels 27.

Void filler 30 is vertically expandable with respect to the door 12 and overlies panels 27 and raised moldings 28 of inner doorskin 14. Filler 30 is of a varied thickness as illustrated in FIG. 1 in application and in FIGS. 3–5 in its isolated collapsed form. It is this varied thickness of void filler 30 that permits the filler to be positioned over the raised moldings 28 to cause a substantial portion of the center of the door to be supported.

Figure 3:
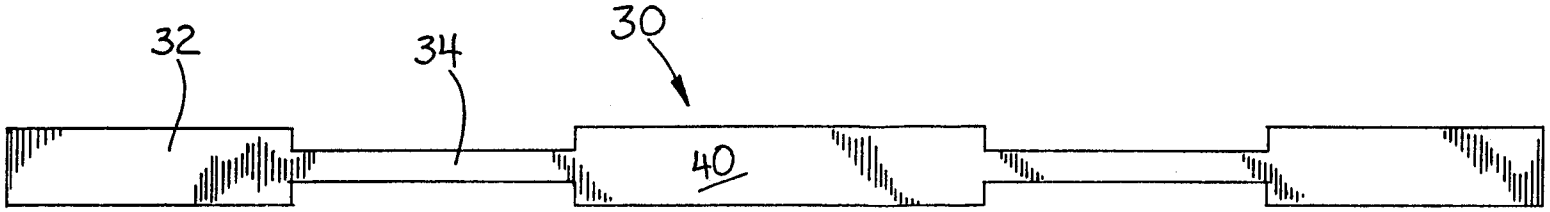
FIG. 3 is an end view of the void filler in its collapsed form.
Figure 4:
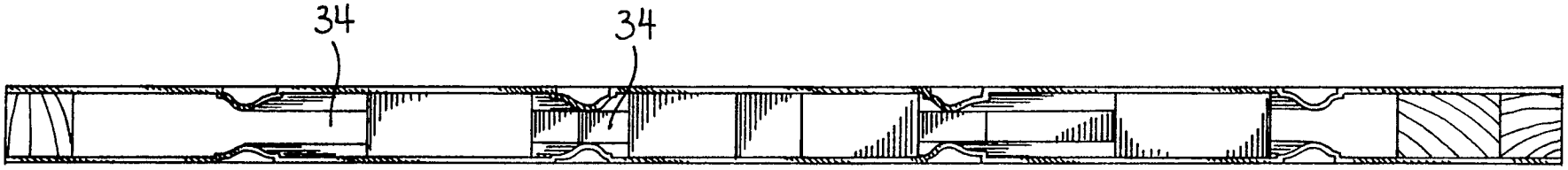
FIG. 4 is a sectional view of the hollow door as seen along lines 4—4 of FIG. 2.
Figure 5:
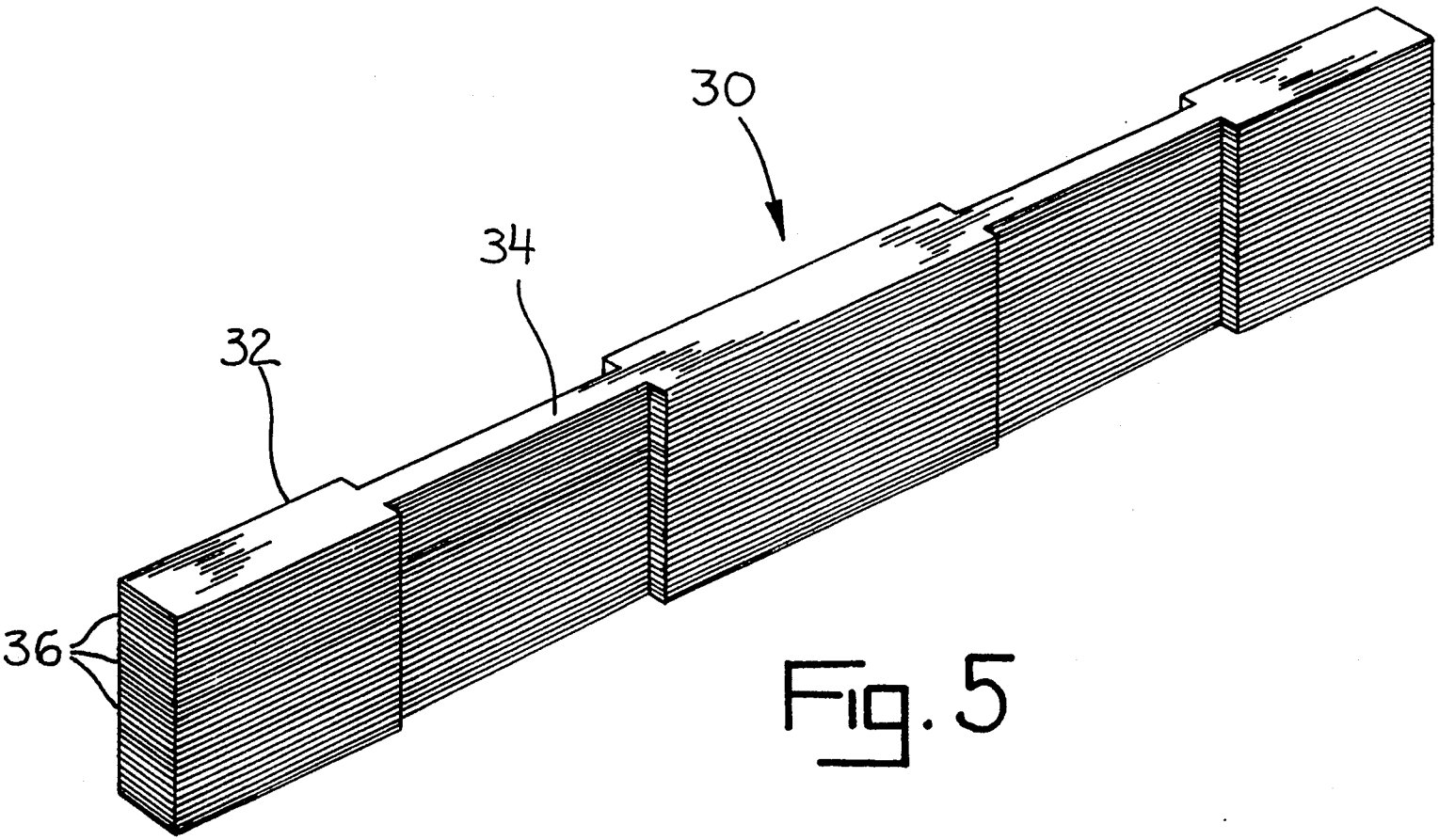
FIG. 5 is a perspective view of the void filler of FIG. 3.

Outer surface 32 of void filler 30 has been relieved at selection locations or sections 34 so as to reduce the cross-sectional dimension of the filler to accommodate the raised moldings 28 of the panels 27. FIGS. 3 and 5 show void filler 30 in its collapsed form having structural components 36 which connect sections 34 of reduced thickness.

Filler 30 is made of corrugated paper sheets which are glued together in stacked form at selected positions. The stacked sheets are then cut in cross-section so as to form individual strips 40 (only one shown) of the laminated paper. The laminated strips are then machined in width so as to form sections 34 as seen in FIG. 5.

When strip 40 is laterally expanded the glued laminates form the expanded void filler 30. Filler 30 is placed over the doorskin 14, preferably glued in place, with the thicker components 36 extending along the center stile 42 of the skin between panels 27 and inside moldings 28 and with the thinner sections 34 being placed over the moldings. The remaining doorskin 16 is placed over filler 30 with components 36 and sections 34 similarly located along the center stile, inside the moldings and over the molding of the doorskin. The doorskins are sealed along peripheral frame 18.

It is to be understood that the invention is not to be limited to the precise form disclosed in the preferred embodiment but may be modified without departing from the scope of the invention as defined in the following claims.

I claim:

1. A hollow door comprising an inner skin and an outer skin with one of said skins having panels formed therein each outlined by a raised molding at the interior surface of the skin, a peripheral frame secured between said skins to separate the skins in a spaced relationship, an integral non-solid void filler located within said frame and between said skins, said filler having interconnected skeletal components and sections, said components being of a specific thickness and said sections being of a thickness reduced from that of said components, said filler components located between said skins separated from said molding and extending between the skins to form a support therefor, said filler sections located between the skins and overlying said moldings.

2. The door of claim 1 wherein said one skin includes stiles separating said panels, and said filler components overlying both said panels and said stiles.

3. The door of claim 1 wherein said skins each have said panels formed therein with each panel outlined by a said raised molding at the interior surface of the skin, each skin including stiles separating said panels of the skin, the panels and stiles of one skin opposing respectively the panels and stiles of the other skin, said filler components positioned between the said opposing stiles and panels of the skins with said filler sections overlying said moldings.

4. The door of claim 1 wherein said filler is made of a material having a collapsed form and an expanded form which permits expansion of the filler from its collapsed form into its extended form in the longitudinal direction of said door with the filler extending from adjacent one part of said frame member to adjacent an opposite part of said frame member.

* * * * *